US007549512B2

(12) United States Patent
Newberry

(10) Patent No.: US 7,549,512 B2
(45) Date of Patent: Jun. 23, 2009

(54) MUFFLER FOR INTERNAL COMBUSTION ENGINE

(76) Inventor: Elroy Newberry, 15314 E. Mineral King Ave., Visalia, CA (US) 93291

( * ) Notice: Subject to any disclaimer, the term of this patent is extended or adjusted under 35 U.S.C. 154(b) by 0 days.

(21) Appl. No.: 11/704,025

(22) Filed: Feb. 7, 2007

(65) Prior Publication Data

US 2007/0205046 A1 Sep. 6, 2007

(51) Int. Cl.
*F01N 1/08* (2006.01)
*F01N 1/02* (2006.01)

(52) U.S. Cl. ..... 181/281; 181/270; 181/264

(58) Field of Classification Search ..... 181/264, 181/269, 270, 281, 282, 224
See application file for complete search history.

(56) References Cited

U.S. PATENT DOCUMENTS

| | | | | | |
|---|---|---|---|---|---|
| 624,062 | A * | 5/1899 | Matthews et al. | ..... | 181/264 |
| 1,084,883 | A * | 1/1914 | Holzwarth | ..... | 181/264 |
| 1,184,431 | A * | 5/1916 | Dodge | ..... | 181/269 |
| 1,597,397 | A * | 8/1926 | Wilkinson | ..... | 181/264 |
| 1,756,916 | A * | 4/1930 | Stranahan | ..... | 181/269 |
| 2,122,086 | A * | 6/1938 | Chase | ..... | 181/269 |
| 2,373,231 | A * | 4/1945 | Demuth | ..... | 181/264 |
| 2,575,233 | A * | 11/1951 | Plasse | ..... | 181/281 |
| 2,609,886 | A * | 9/1952 | Harmon | ..... | 181/269 |
| 2,851,123 | A * | 9/1958 | Leistritz | ..... | 181/281 |
| 2,950,776 | A * | 8/1960 | Stephens | ..... | 181/224 |
| 4,331,213 | A * | 5/1982 | Taniguchi | ..... | 181/263 |
| 4,574,914 | A * | 3/1986 | Flugger | ..... | 181/268 |
| 4,660,676 | A * | 4/1987 | Eustace | ..... | 181/224 |
| 4,809,812 | A * | 3/1989 | Flugger | ..... | 181/268 |
| 4,890,691 | A * | 1/1990 | Ching-ho | ..... | 181/264 |
| 5,123,502 | A * | 6/1992 | Flugger | ..... | 181/264 |
| 5,304,749 | A * | 4/1994 | Crandell | ..... | 181/264 |
| 5,444,197 | A * | 8/1995 | Flugger | ..... | 181/264 |
| 5,739,484 | A * | 4/1998 | Jones | ..... | 181/264 |
| 6,050,363 | A * | 4/2000 | Tu | ..... | 181/264 |
| 6,089,347 | A * | 7/2000 | Flugger | ..... | 181/264 |
| 6,286,623 | B1 * | 9/2001 | Shaya | ..... | 181/264 |
| 6,302,235 | B1 * | 10/2001 | Matherne | ..... | 181/268 |
| 6,374,944 | B1 * | 4/2002 | Curl, Jr. | ..... | 181/282 |
| 6,651,773 | B1 * | 11/2003 | Marocco | ..... | 181/270 |
| 6,776,257 | B1 * | 8/2004 | Shaya | ..... | 181/272 |
| 7,219,764 | B1 * | 5/2007 | Forbes | ..... | 181/270 |
| 2005/0205353 | A1 * | 9/2005 | Chen | ..... | 181/270 |
| 2006/0054384 | A1 * | 3/2006 | Chen | ..... | 181/272 |

* cited by examiner

*Primary Examiner*—Edgardo San Martin
(74) *Attorney, Agent, or Firm*—Dergosits & Noah LLP

(57) ABSTRACT

The improved muffler design has a housing that is hexagonal in shape that is formed from an upper plate, a lower plate and sidewalls that form a perimeter around the housing. An inlet and outlet are attached to opposite sides of the housing along the length. A primary vein is mounted within the housing with that allows some of the gases to around the vein and some of the gases to flow through holes in the leading surface of the primary vein. A secondary vein is mounted downstream of the primary vein and a mixing vein is mounted downstream of the secondary vein. The widest point more of the housing is closer to the than the outlet so the housing resembles a coffin.

20 Claims, 5 Drawing Sheets

MUFFLER FOR INTERNAL COMBUSTION ENGINE

FIELD OF INVENTION

This invention relates to mufflers for internal combustion engines, and particularly to automotive vehicle mufflers.

BACKGROUND

The muffler for an internal combustion engine functions to suppress or modulate the noise emanating from the running engine. A problem with mufflers is that the reduction in noise frequently causes back pressure at the outlet of the engine. This back pressure causes a reduction in the efficiency of operation of the engine, causing lower fuel efficiency and lower power output.

The suppression of the engine exhaust noise has been approached by use of mufflers connected in fluid flow communication with a manifold with which the exhaust ports from the engine cylinders are connected. Exhaust gases and acoustic noise associated with the firing of a fuel in the engine cylinders are transmitted to the muffler. The muffler directs the exhaust gases through a housing having sharp turns, sharp edges, packing of various types, baffles, and perforated or non-perforated tubing are used to alter the flow of the gases and reduce the noise through the muffler in attempts to change the direction of flow of the gases and accompanying noise as they pass through the muffler, all with the intent to reduce the noise level exiting the muffler while minimizing the resistance to flow of the gases through the muffler, thereby minimizing the back pressure to the engine.

SUMMARY OF THE INVENTION

The inventive muffler has an elongated housing having an inlet and an outlet. In an embodiment, the housing has an upper plate and a lower plate that are both elongated hexagonal in shape. Sidewalls are attached between the edges of the upper and lower plates. The inlet is attached to one side and the outlet is attached to a side opposite the inlet. The widest point area of the muffler is preferably closer to the inlet than the outlet.

A plurality of internal veins are mounted within the housing. The primary vein is closest to the inlet and has a number of surfaces that diver the exhaust gases from the inlet. Leading surfaces of the primary vein have holes and are configured to form an angle that extends outward towards the output. Tapered surfaces are attached to the leading surfaces and are angled inward. Flared surfaces are attached to the tapered surfaces that extend back outward towards the outlet.

The second vein is mounted between the primary vein and the outlet. In an embodiment, the secondary vein has two surfaces that form an outward angle towards the outlet. The mixing vein is mounted between the secondary vein and the outlet. The mixing vein is similar in shape to the secondary vein with two surfaces that form an outward angle towards the outlet.

When the inventive muffler is used, exhaust gases travel through the inlet and contact the primary vein. Most of the gases flow around the primary vein which creates a low pressure zone as the gas flows across the ends of the primary vein and the secondary vein. The low pressure pulls some gases through the holes in the leading surfaces of the primary vein. The gas that flows through the holes in the leading surfaces travels through the interior area of the primary vein between the tapered and the flared surfaces. The gases traveling through the center of the primary vein are then diverted around the secondary vein. The secondary vein causes the gases flowing through and around the primary vein to mix. Some of the gases then contact the mixing vein and into the resonation dampening space where the gases swirl and mix. The gas then flows around the mixing vein to the outlet where it is exhausted to the atmosphere.

The shape of the primary vein and the housing cause the gases to accelerate and mix due to the changes in cross section along the flow path. More specifically, the gases accelerate and depressurizes as the flow path cross section narrows. Conversely, the gases decelerate and pressurizes when the flow path cross section expands. The physics of gas flow through a narrowing and expanding flow path is known as a venturi effect. By mixing the compression and velocities, the gas tends to mix which causes it to dissipate energy and reduce noise.

The inventive muffler reduces the back pressure because the flow of gas is not diverted significantly. In a conventional muffler, the gases are required to flow through a convoluted flow path that bends around very sharp angles. In contrast, the inventive muffler generates turbulent flow with a fairly straight flow path. Based upon conservation of energy laws of physics, the lost energy caused by the mixing of the exhaust gases may be converted into heat energy. The inventive muffler provides the necessary noise reduction with reduced back pressure to the engine.

DETAILED DESCRIPTION

Figure 1:
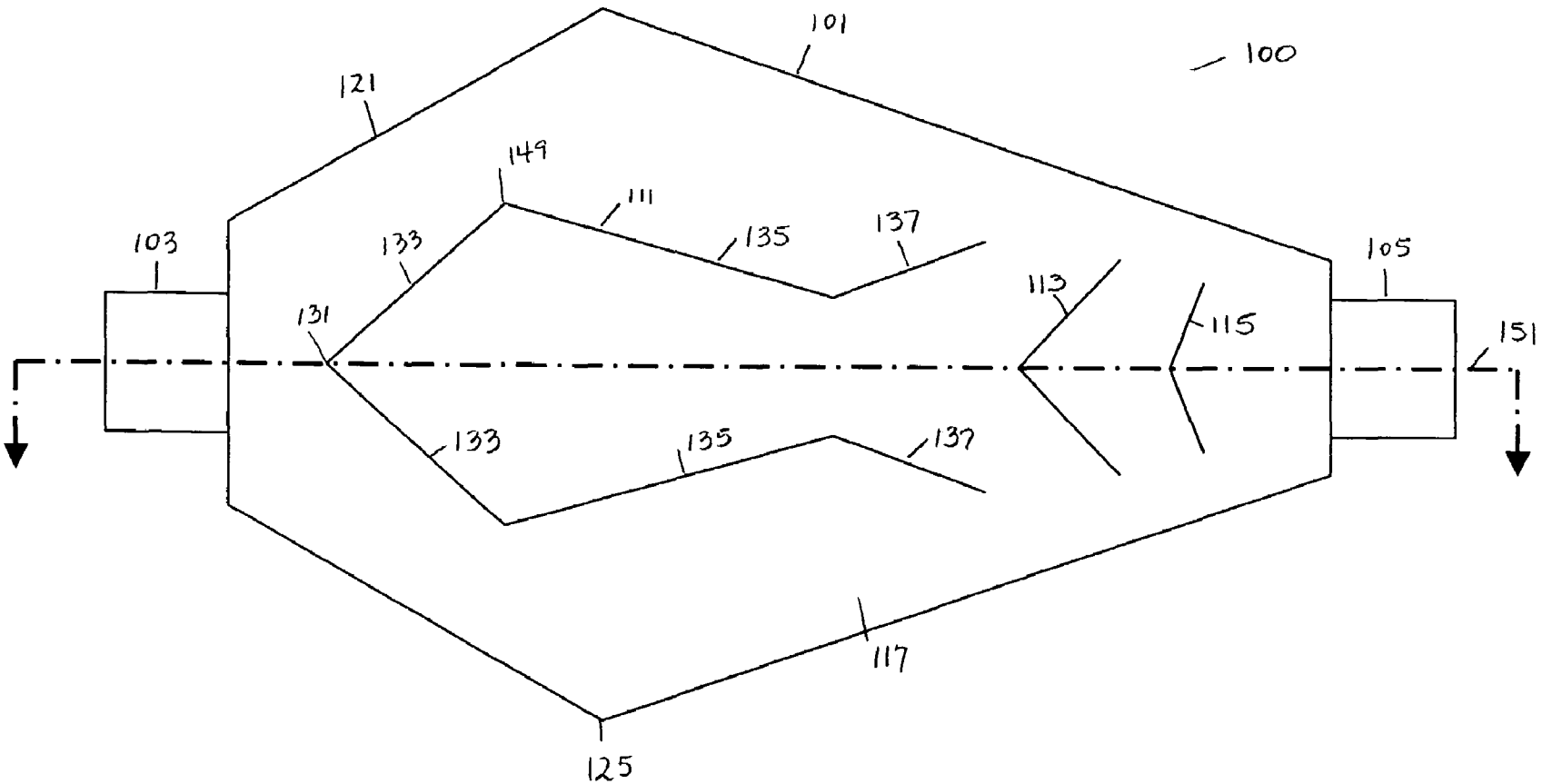
FIG. 1 illustrates a top cross sectional view of an embodiment of the muffler.

With reference to FIG. 1, a top cross sectional view of an embodiment of the inventive muffler 100 is illustrated. The inventive muffler 100 includes: an inlet 103 that leads into a housing 101, a primary vein 111, a secondary vein 113, a mixing vein 115 and an outlet 105. The inlet 103 is coupled to the outlet of an internal combustion engine or the outlet of a catalytic converter. Exhaust gases travel through the muffler 100 and exit the outlet 105 and possibly additional piping before being vented to the atmosphere. The inlet 103 and outlet 105 are preferably tubular with circular cross sections but in other embodiment, the inlet 103 and outlet 105 may have any other geometric cross section.

In the preferred embodiment, the housing 101 is an elongated hexagonal shape, similar to a coffin. The sidewalls 121 are narrow in width close to the inlet 103 and then expand to their widest point 125 before the mid length. The sidewalls 121 then taper inward towards the outlet 105 of the muffler 101. The flat upper plate and lower plate 107 are flat and the sidewalls 107, the primary vein 111, secondary vein 113 and mixing vein 115 are configured in a substantially perpendicular orientation between the upper and lower plate 107. Because FIG. 1 is a cross sectional view, the upper plate is not shown. In this embodiment, the upper plate is substantially similar in appearance and lower plate 117.

The primary vein 111 has a pointed end 131 formed by two leading surfaces 133. The leading surfaces 133 have a plurality of holes (not shown) that are distributed across the surface.

The holes are preferably circular but may be any other shape, slots, rectangular, triangular, oval, etc. The widest point 149 of the primary vein 111 is preferably located upstream of the widest point 125 of the sidewalls 121. The widest point 149 of the primary vein 111 is formed at the junction of the leading surfaces 133 and the tapered surfaces 135 which extend inward towards the outlet 105 of the muffler 101. The tapered surfaces 135 are coupled to flared surfaces 137 which extend outward towards the outlet of the muffler 101.

Figure 2:
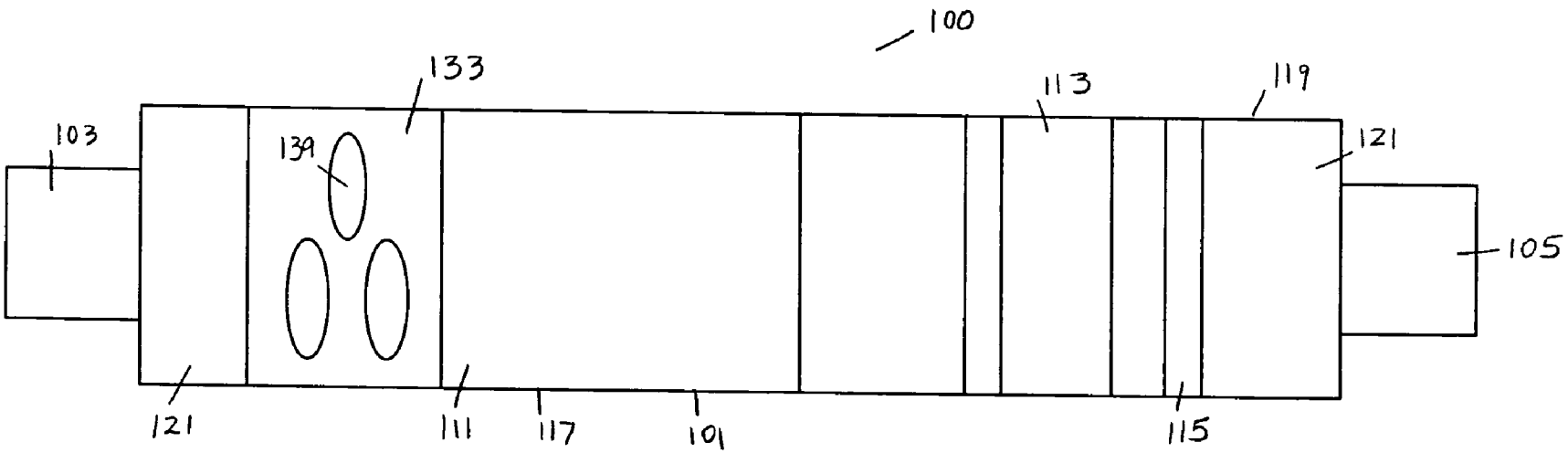
FIG. 2 illustrates a side cross sectional view of an embodiment of the muffler.

FIG. 2 illustrates a cross sectional side view of an embodiment of the inventive muffler 100 along the center line 151 shown in FIG. 1. The primary vein 111, secondary vein 113 and mixing vein 115 are mounted between the upper plate 119 and the lower plate 117 which are planar in this embodiment. In other embodiments, the upper plate 119 and the lower plate 117 have curved or angular features. The leading surface 133 includes a plurality of holes 139 which allow some of the exhaust gases to travel through the primary vein 111.

Figure 3:
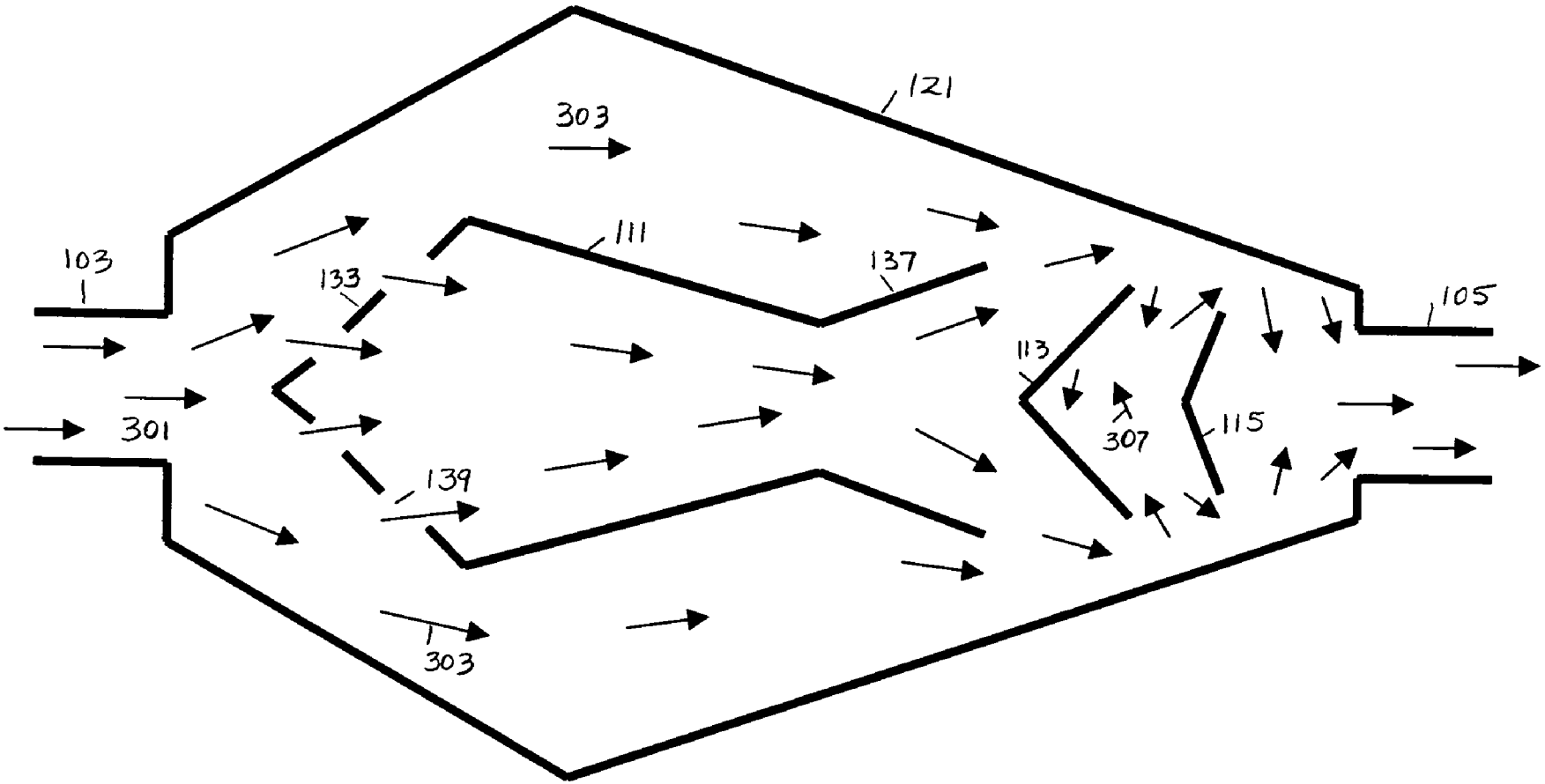
FIG. 3 illustrates the gas flow path through the muffler.

With reference to FIG. 3, a plurality of arrows illustrate the gas flow paths through the inventive muffler. Exhaust gases 301 enter the muffler 100 through the inlet 103. Some of the gases 303 flow between the external sidewalls 121 and the leading surface 133 of the primary vein 111. The flow path between the sidewalls 121 of the muffler 100 and the primary vein 133, varies in cross section causing the exhaust gases to change velocity as they flow around the primary vein 111. Exhaust gases 303 passing around the primary vein creates a "venturi." A venturi is a constriction in a flow path that causes an increase in gas velocity and a pressure drop when a higher velocity gas flows through it.

The narrowest cross section is between the sidewalls 121 and the flared surface 137 outlet end of the primary vein 111. This is where the gas 303 velocity is the highest and the static pressure is the lowest. This increase in velocity at the ends of the flared surfaces 137 result in a low pressure volume in the space between the primary vein 111 and the secondary vein 113. This low pressure pulls exhaust gases through the holes 139 in the leading surface 133 of the primary vein 111. In essence that is where the muffler 100 uses the exhaust gases from the vehicle, to speed up the flow of gas through the muffler 100.

In an embodiment, the secondary vein 113 is a simple wedge shaped internal wall that is mounted at the exhaust end of the primary vein 111. The mixing vein 115 is also a wedge shaped internal wall. As the exhaust gases 305 continues past the primary vein 111 to the secondary vein 113, some of the gases 307 enter the area called the "resonation dampening space" between the secondary vein 113 and the mixing vein 115. This space allows both sides of exhaust flow to have the exact same sound tone as it passes through the outlet 105 of the muffler 100. When these events take place inside the muffler 100, the end result, is an improved muffler 100 with greater flow capabilities, more aggressive sound, better horsepower, and better torque for the vehicle. All exhaust gases eventually exits the muffler 100 through the outlet 105.

Figure 4:
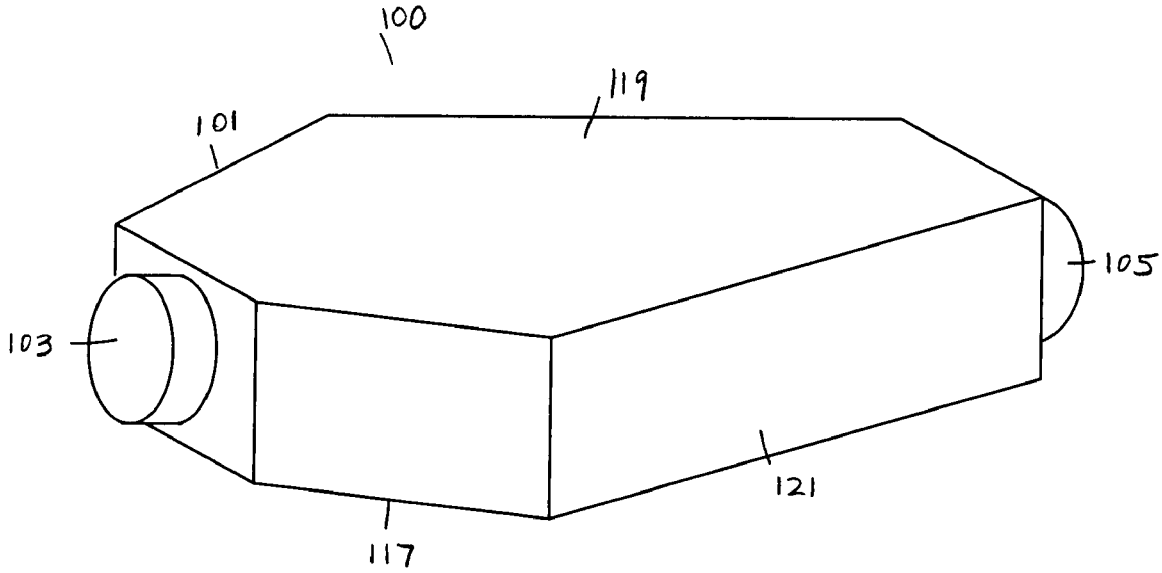
FIG. 4 is an elevation view of an embodiment of the muffler.

FIG. 4 illustrates an elevation view of the inventive muffler 100. The inlet 103 is coupled to the front of the housing 101 and the outlet 105 is coupled to the back of the housing 101. The sidewalls 121 are attached to the outer edges of upper plate 119 and the lower plate 117. Although, the internal components are shown as having sharp bends, it would also be possible for the muffler to be constructed with more rounded features. For example, the external walls may curve around from the inlet to a wide point and the gradually taper towards the outlet. Similarly, the primary vein, secondary vein and mixing vein may be curved instead of being sharply bent. The primary objective is to create a venturi between within the muffler to generate a low pressure that sucks air through holes in the primary vein.

In an embodiment, the inventive muffler is made of sheet metal such as anti-corrosive stainless steel, titanium, aluminum, etc. While the components are fabricated out of the sheet metal, it is also possible to further improve the performance by adding coatings to the sheet metal components that will further absorb sound. For example, the housing may have a sandwich construction with a noise insulative layer placed between inner and outer metal sheets. The inner walls of the housing may be perforated so that the insulative layer is exposed to the exhaust gases. The insulative materials such as fiber glass, felt and other materials that do not provide smooth surfaces for noise reflection are able to withstand high levels of heat and provide a noise dampening effect.

Figure 5:
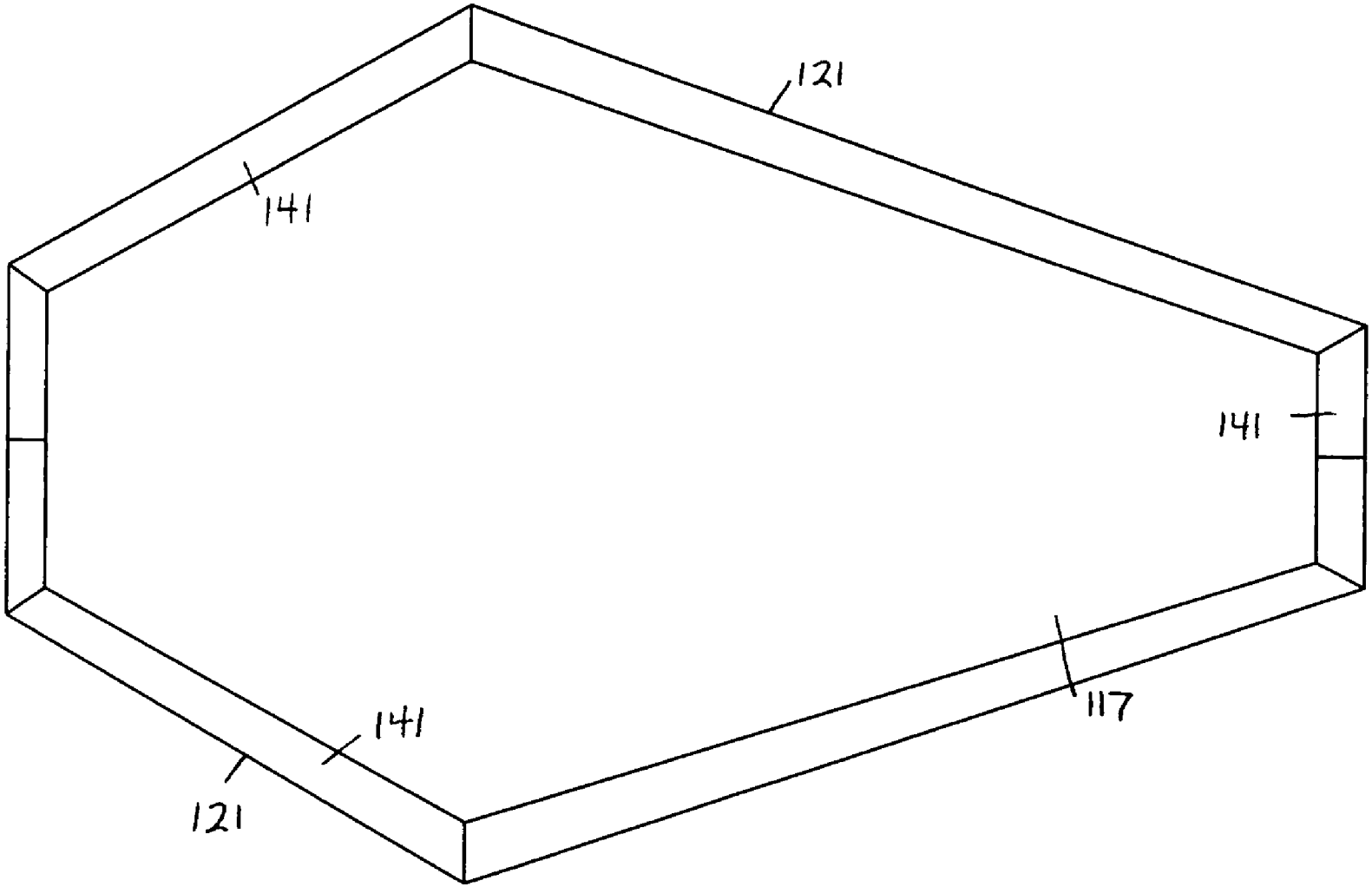
FIG. 5 is a top view of the sidewalls of the muffler housing.

As discussed, the housing includes the sidewalls as well as upper and lower surfaces. In the preferred embodiment, the intersections of these components should be welded together to form gas tight seams to prevent gas from leaking out of the muffler. With reference to FIG. 5, in an embodiment, the edges of the side walls 121 have flanges 141 that over lap the upper and lower plate 117. The flange may be about ⅛ to 1 inch wide that provide a wide surface to weld the muffler components together, i.e. the sidewalls 121 to the upper plate 119 and the lower plate 117. In other embodiments, the housing components may be bonded to each other to for a sealed enclosure by any other means including fasteners, adhesives, interference press fits, etc.

The internal components including the primary vein, secondary vein and mixing vein may have tabs on their edges that engage holes in the upper and lower pieces. The tabs may be small rectangular protrusions located at the ends and bent corners of the internal components. The holes in the upper and lower pieces may be about 1/16 to about ¼ inch in diameter or alternatively, rectangular holes. The internal components may be spot welded to the upper and lower pieces at the tab/hole junctions or along the contact areas between the edges of the internal components and the upper and lower pieces. In yet another embodiment, an adhesive may be used to bond the muffler components together.

Although the inventive muffler may have any geometric dimensions, it is primarily designed for cars. For many automotive applications, the muffler may be about 3-6 inches in thickness, preferably 4 inches. The length may be between about 10-20 inches, preferably 15 ⅝ inch and the maximum width may be between about 4 and 12 inches, preferably 8 ⅝ inch. The widths at the ends may be about 2-6 inches. The inlet side is preferably 4.35 inches and the outlet side is preferably 3.606 inches. In the preferred embodiment, the inlet and outlet are circular tubes which may be about 3 inches in diameter. For smaller engines such as motorcycles, the dimensions may be smaller and for larger applications the size of the muffler may be greater, i.e., trucks, tractors and other industrial engines. The operation does not depend upon the type of engine and it will work well with diesels, both cars and pickups.

The internal design of the inventive muffler allows engines to generate more torque and more horsepower, yet still increasing fuel economy-all at the same time. The muffler is able to do this by freeing up the back pressure of the engine's exhaust system. By reducing the gas flow resistance, the exhaust can escape easily and The improved performance of the inventive muffler results in much less flow through resistance. Which is similar to the difference between blowing through a plastic straw and blowing through a garden hose that allows air to escape faster and with less effort. This improved performance results in longer engine life, more instantaneous throttle response, better fuel economy, and an aggressive sound that is popular. The inventive muffler provides a simple and affordable product provides significant economic and environmental benefits.

While the present invention has been described in terms of a preferred embodiment above, those skilled in the art will readily appreciate that numerous modifications, substitutions and additions may be made to the disclosed embodiment without departing from the spirit and scope of the present invention. It is intended that all such modifications, substitutions and additions fall within the scope of the present invention.

What is claimed is:

1. A muffler for exhaust gases from an internal combustion engine comprising:

a housing having an inlet, an outlet, an upper plate, a lower plate and sidewalls wherein the upper plate and the lower plate are hexagonal in shape, the sidewalls are mounted between the upper plate and lower plate, the inlet is coupled to a first side of the housing and the outlet is coupled to a side of the housing opposite the first side; and a primary vein mounted in the housing that has two leading surfaces that form an angle that extends outward towards the outlet and have a plurality of holes, tapered surfaces that are coupled to the leading surfaces that extend inward towards the outlet and flared surfaces that are coupled to the tapered surfaces and extend outward towards the outlet; wherein some of the exhaust gases flowing through the muffler are diverted between the sidewalls and the primary vein and some of the exhaust gases pass through the perforations in the leading surfaces and between the two tapered surfaces and the two flared surfaces.

2. The muffler of claim 1, further comprising:

a secondary vein mounted between the primary vein and the outlet.

3. The muffler of claim 2, further comprising:

a mixing vein mounted between the secondary vein and the outlet.

4. The muffler of claim 1, wherein the perforations in the leading surfaces are less than 1 inch in diameter.

5. The muffler of claim 1, wherein the intersection of the two leading surfaces forms an angle that is less than about 120 degrees.

6. The muffler of claim 1, wherein the upper surface and the lower surface are substantially planar.

7. The muffler of claim 1, wherein the upper surface and the lower surface are substantially parallel.

8. The muffler of claim 1, wherein the leading surfaces are substantially planar.

9. The muffler of claim 1, wherein the distance between the upper surface and the lower surface is less than 6 inches.

10. The muffler of claim 1, wherein the housing has a width that is less than 12 inches.

11. The muffler of claim 1, wherein the housing has a length that is less than 20 inches.

12. The muffler of claim 1, wherein the leading surfaces are substantially perpendicular to the upper surface and the lower surface.

13. The muffler of claim 1, wherein the housing and primary vein are made of stainless steel.

14. The muffler of claim 1, wherein the sidewalls include flanges that overlap portions of the upper surface and the lower surface.

15. The muffler of claim 1, wherein the widest portion of the housing is closer to the inlet than the outlet.

16. A muffler for exhaust gases from an internal combustion engine comprising:

a housing with an inlet at one end and an outlet at an opposite end; and a primary vein mounted within the housing that has two leading surfaces that form an angle that extends outward towards the outlet and have a plurality of holes, tapered surfaces that are coupled to the leading surfaces that extend inward towards the outlet and flared surfaces that are coupled to the tapered surfaces and extend outward towards the outlet; and wherein some of the exhaust gases traveling through the inlet are diverted around the primary vein to the outlet, some of the exhaust gases pass through the holes in the leading surfaces through the primary vein to the outlet.

17. The muffler of claim 16, further comprising:

secondary vein mounted between the primary vein and the outlet;

a mixing vein mounted between the secondary vein and the outlet;

wherein some of exhaust gases travel between the secondary vein and the mixing vein.

18. The muffler of claim 16, wherein the intersection of the two leading surfaces forms an angle that is less than about 120 degrees.

19. The muffler of claim 16, wherein a widest portion of the housing is closer to the inlet than the outlet.

20. The muffler of claim 16, wherein the primary vein includes tapered surfaces that are coupled to the leading surfaces and extend inward toward towards the outlet.

* * * * *